US011700955B2

(12) United States Patent
Tassara Carrasco

(10) Patent No.: US 11,700,955 B2
(45) Date of Patent: Jul. 18, 2023

(54) PEDESTAL ALARM

(71) Applicant: DISTRIBUCIÓN Y MARKETING LTDA., Santiago (CL)

(72) Inventor: Mauricio Enrique Tassara Carrasco, Santiago (CL)

(73) Assignee: Distribucion y Marketing LTDA., Santiago (CL)

( * ) Notice: Subject to any disclaimer, the term of this patent is extended or adjusted under 35 U.S.C. 154(b) by 224 days.

(21) Appl. No.: 17/176,015

(22) Filed: Feb. 15, 2021

(65) Prior Publication Data

US 2022/0257032 A1 Aug. 18, 2022

(51) Int. Cl.
*A47F 3/00* (2006.01)
*G08B 13/00* (2006.01)

(52) U.S. Cl.
CPC ..... *A47F 3/002* (2013.01); *G08B 13/00* (2013.01)

(58) Field of Classification Search
CPC ..... G08B 13/00; G08B 13/2474; A47F 3/002
USPC ..... 40/722, 723, 724
See application file for complete search history.

(56) References Cited

U.S. PATENT DOCUMENTS 4,872,018 A 10/1989 Feltz et al.
4,943,799 A * 7/1990 Papineau ..... G08B 13/19 340/541
5,260,853 A * 11/1993 Yap ..... G08B 13/2474 220/684
5,720,547 A * 2/1998 Baird ..... A47B 87/008 312/107
7,299,578 B2 * 11/2007 Molinaro ..... G09F 19/22 40/606.01
8,875,430 B2 * 11/2014 Leboff ..... A47G 1/12 40/722
8,935,837 B2 * 1/2015 Jairala, Jr. ..... A61G 17/08 40/725
2012/0133253 A1 * 5/2012 Bergevin ..... A47B 47/042 312/204

FOREIGN PATENT DOCUMENTS

EP 0352513 1/1990
EP 0668626 8/1995
EP 0668626 A1 * 8/1995 ..... A47B 47/042
EP 1610288 12/2005
EP 1610288 A2 * 12/2005 ..... G08B 13/2474
ES 2264620 B1 * 11/2007 ..... G08B 13/04

* cited by examiner

*Primary Examiner* — Matthew W Ing
(74) *Attorney, Agent, or Firm* — Bay State IP, LLC

(57) ABSTRACT

A pedestal antenna for anti-theft systems in commercial establishment's entrances, which has the advantage or benefit of allowing the exhibit of physical or physical objects for exhibit or immediate access for the client as a display window which is immediately perceived by the client when they walk into the premises, as they also do when leaving the premises, as this product showcasing spot is in the same pedestal antenna, located at the access door.

12 Claims, 7 Drawing Sheets

PEDESTAL ALARM

This Utility Model is related to the functional conditioning of security assets, such as anti-theft security pedestal alarm systems used for walk-in control in the main entrance in commercial establishments.

Specifically, this model is related to a security pedestal which can also be used as publicity media and as a product exhibit.

PRIOR ART DESCRIPTION

Amongst security measures applied in commercial establishments, there are anti-theft pedestals which are installed at entrances, they allow to automatically supervise people's movements in order to avoid them leaving the store in a fraudulent manner, with unpaid products.

These anti-theft pedestals are usually arch-shaped structures, which serve as antennas for the previously mentioned security service. As this elements are notably exposed in their places of use, it is also important for them to have good aesthetical qualities, or to make use of them so they accomplish an accessory function, in addition to their security function.

Security tags that can be detected by security systems are attached to the products which need to be protected. The product's security system is composed by transmission and reception devices, specifically in the exit area. In a regular payment procedure at the cash register, the safety tag is eliminated or cancelled. In case of theft, the products go through the system with the safety tags in the products, and since the transmission and reception devices have vertical antennas, like a pedestal, positioned one in front of the other, the antennas emit a signal, such as radiofrequency signals. If a product's security tag goes through the area in between the transmission and reception antenna, a resonant circuit inside of it is triggered and it emits a resonant frequency, which can be detected by the reception antenna, and the receiving system emits an optical and audible alarm signal.

One example of a pedestal antenna is described in the U.S. Pat. No. 4,872,018 on 3 Oct. 1989 by MONARCH MARKET SYSTEMS, which features a very basic antenna pedestal composed by a transom frame with empty spaces in the middle and a closed bottom area where the connection systems are. A similar structure example is featured in EP0352513 by KNOGO on 31 Jan. 1990, composed by a simple frame with two transoms at mid-height.

These electronic security systems have been empirically proved to work, that's why they represent an important asset in theft prevention. A disadvantage, however, is the space they take in the entrance area, in where they only serve as an anti-theft device.

An improvement has been made in security pedestal's functionalities, in which their vertical panels have been used as graphic information holders, such instance has been described in EP1610288 on 28 Dec. 2005 by NIEUES HEINZ-ULLRICH, in which the pedestal is covered with transparent material, and is able to be used as publicity showcasing.

A similar yet much more complex solution to the previous one is described on EP0668626 IN 23 Aug. 1995 BY SENSORMATIC ELECTRONIC, in which a pedestal can be seen completely encased by some sort of cover that defines an upper section in which you can put publicity in.

Although the previously described solutions attempt to give the antenna pedestal an additional function besides security, allowing it to serve as a publicity spot, remain to be elements which still won't allow to exhibit other kinds of publicity or physical products, such as physical promotional objects.

That's why it becomes necessary to find a solution which not only allows to have pedestal alarm systems in store accesses, but to also make use of them as physical products placement spots, be them publicity, promotional, or service products for the client; for example, serve as a spot for pamphlets or magazines that the client can grab when coming in or getting out of the store, or as a spot for information or graphic publicity which can be removed or replaced easily.

UTILITY MODEL DESCRIPTION

This Model's main objective is to provide a pedestal antenna for anti-theft systems in commercial establishment's entrances, which has the advantage or benefit of allowing the exhibit of physical or physical objects for exhibit or immediate access for the client as a display window which is immediately perceived by the client when they walk into the premises, as they also do when leaving the premises, as this product showcasing spot is in the same pedestal antenna, located at the access door.

Another main objective is to provide an alarm pedestal which allows to dispose of graphic information in an easy way, which can be easily accessed or replaced.

As such, this Model consists of an anti-theft pedestal alarm system to be used at the entrance of commercial establishments, which allows to dispose of graphical information and the exhibit of physical objects.

The pedestal is composed by a perimeter frame shaped structure with the means to hold and exhibit physical objects and graphic support media to install and remove the graphic information porters.

The perimeter frame shaped main structure contains the electric circuits related to the anti-theft alarm, as that system is not part of the scope of this invention.

The frame shaped structure includes a center space which has the means to hold and exhibit physical products and graphic support media.

The exhibit and holding areas consist of a box like, translucent in appearance casing made of plastic or any similar material. This casing allows to hold and exhibit products inside of it, like a display cabinet, for this reason, the casing's dimensions may be greater than those of the pedestal antenna in order to hold the product to exhibit.

The casing consists of delimiting panels, such as vertical opposing panels, upper and lower panels. The vertical panels have connection points to a frontal and posterior panel, which are the biggest ones and allow to see the exhibited product in the casing, alternatively, both frontal and posterior panels, or only one of them, can be removable, however, for production efficiency and safety of the contents inside the casing, it would be preferable that only one of said panels were to be removed in order to put a product in or out of the casing.

The width of the casing is greater than those of pedestal alarm systems, which are normally 40 mm wide, meanwhile, the casing to feature the product in could be approximately 100 mm wide.

The opposing lateral panels, which are part of the delimiting panels of the casing, include connection points to the interior side of the pedestal. For example, it could be a drill hole which allows to be fixated via anchor bolt or other similar means.

As it was said, the lateral panels have connection points to the frontal and posterior panels of the casing, such connection points consist of a ribbed profile to guide and slide either the frontal or posterior panels, so the panels are inserted or removed with a lineal movement, guided by the mentioned ribbed profile.

The casing includes a closing device to ensure the closing position of the panels to the rest of the casing, such as a hasp to place a padlock or lock in it, in order to impede any unauthorized access.

The casing's superior panel may contain a notch in one or both bigger edges, allowing to insert ones fingers and remove the panel with ease. These frontal and posterior panels may have curved sheets, flat sheets, or a mixture of both.

The means of graphic support to install or remove sheets with graphic information include parallel panels that are secured in a removable manner at the inside of the framing through a smaller-lighter frame, which can be made, for example, of aluminum.

Said parallel panels are translucent in appearance, made of, for example acrylic or any equivalent material and are shaped flat, curved or a mixture of both.

The pedestal has an inferior base, bigger in size, which ensures stability and permanence in the location point.

FIGURE DESCRIPTION

A detailed description of the Utility Model will proceed, along with the figures which are a main aspect of this presentation. The intent of these figures is to demonstrate its functionality and main components based on the preferred uses, however, there can exist other uses, also recognized by the inventive concept. As such, the current figures do not limit the scope of the invention, but they are just means of illustration for the understanding its principle, so we have that:

DETAILED DESCRIPTION OF THE PREFERRED USE OF THE MODEL

The model consists of a pedestal for anti-theft alarm system to be used at the entrance of commercial establishments, which allows to dispose of graphical information and the exhibit of physical objects.

Figure 1:
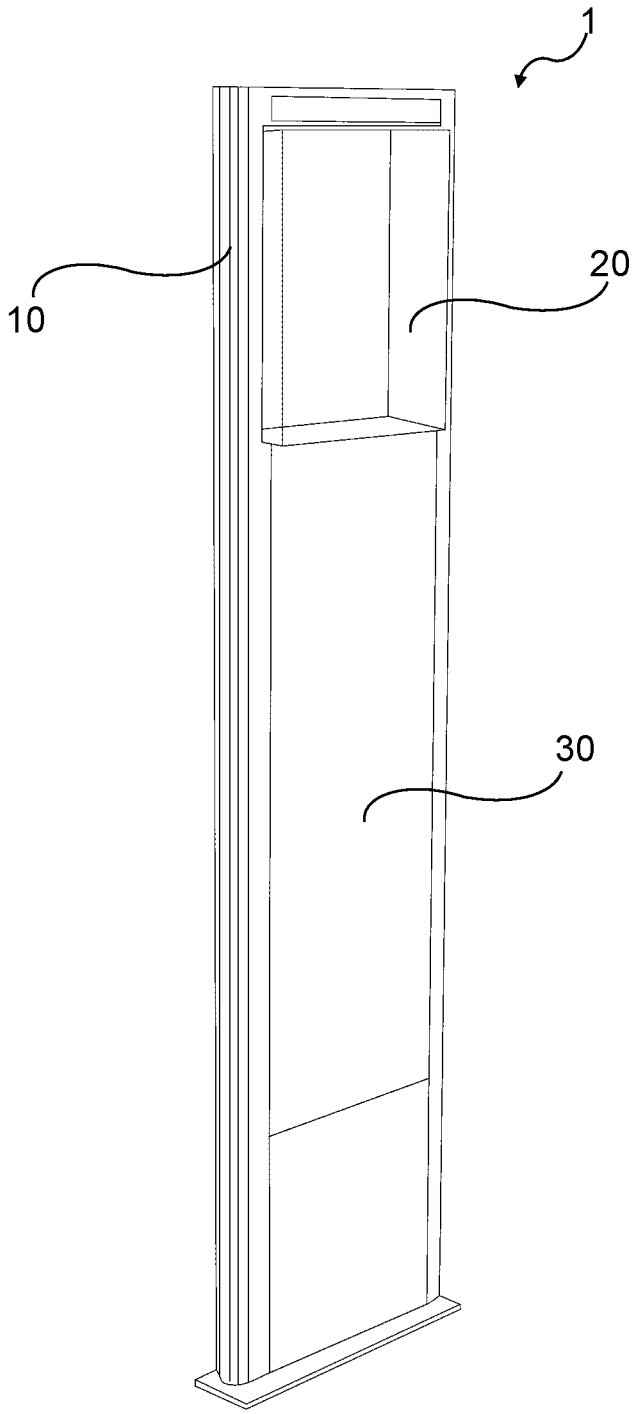
FIG. 1 shows an isometric view of the pedestal.

As appreciated in FIG. 1, the pedestal (1) consists of a perimeter frame shaped main structure (10) with means to hold and exhibit (20) volumetric products and means of graphic support (30) to install and remove graphic information sheets. Said perimeter framing (10) contains the circuits related to the anti-theft alarm.

Figure 2:
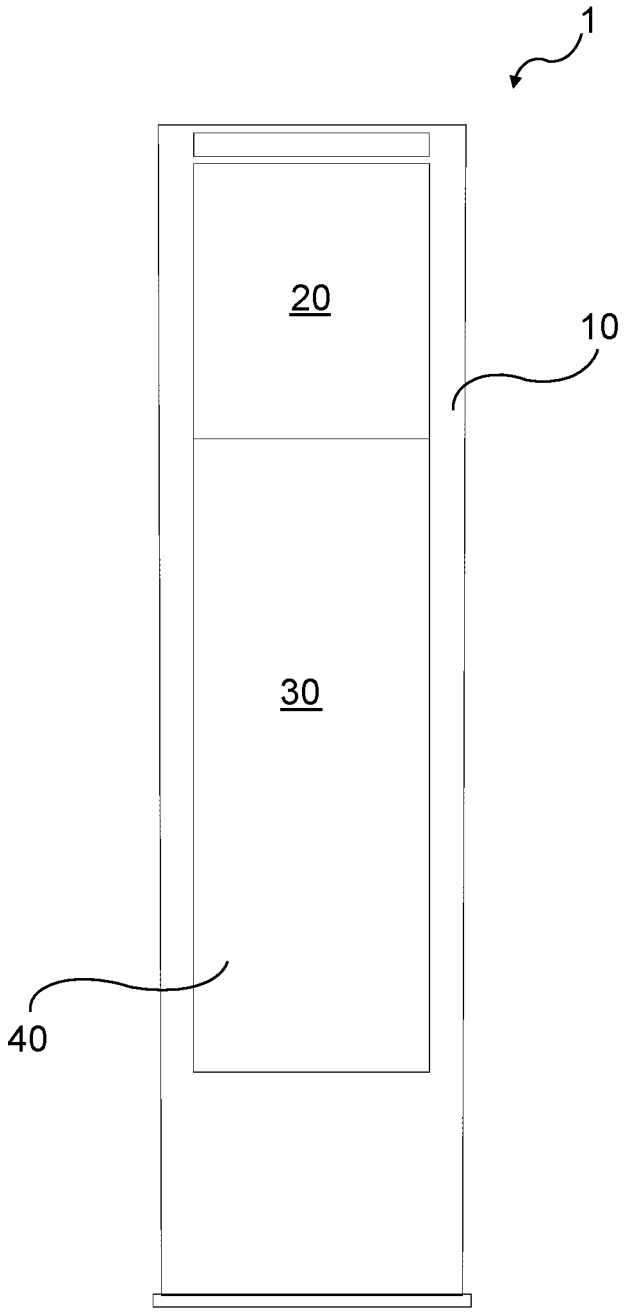
FIG. 2 shows an elevated-frontal view of the pedestal.

As illustrated in FIG. 2, the perimeter frame (10) includes a center space (40) which has the means to hold and exhibit (20) physical products and graphic support media (30).

Figure 3:
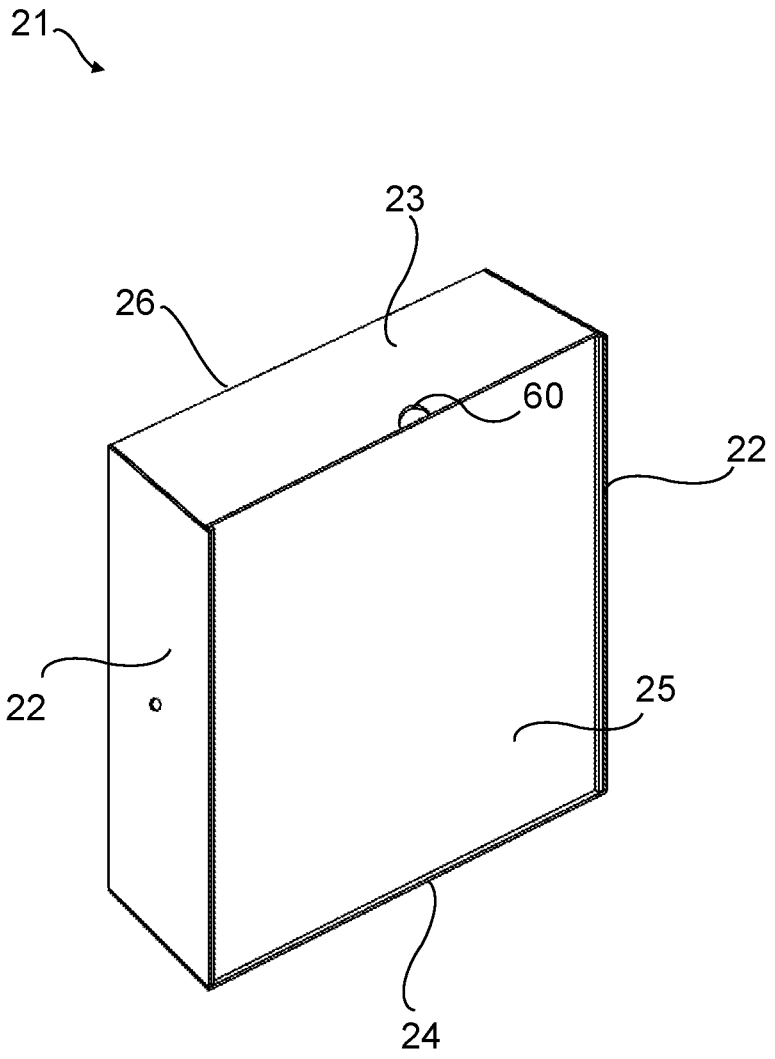
FIG. 3 shows an isometric of the casing in a closed state, according to one of the preferred modalities.
Figure 4:
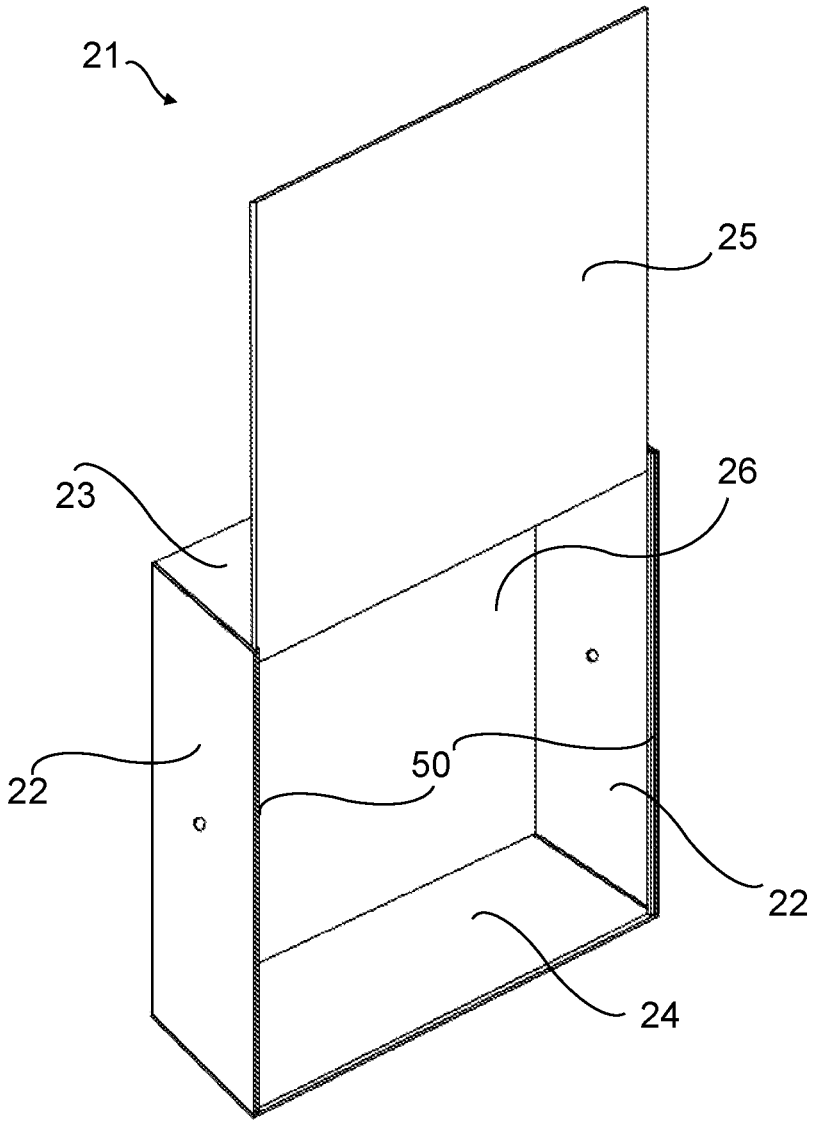
FIG. 4 shows an isometric of the casing in an opened state, according to one of the preferred modalities.

As illustrated in FIG. 3 and FIG. 4, the means of holding and showcasing (20) volumetric products consist of a box like, translucent casing (21), composed by a superior panel (23), inferior panel (24), lateral panels (22) with connection points (50) to a frontal panel (25) and to a posterior panel (26).

Figure 5:
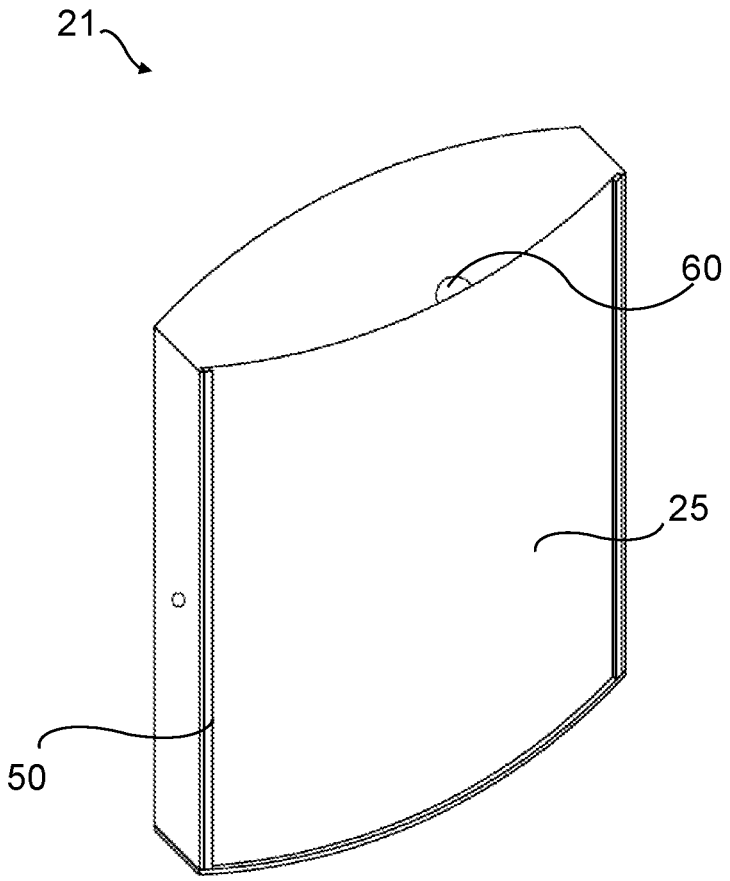
FIG. 5 shows an isometric of the casing in a closed state, according to one of the preferred modalities.
Figure 6:
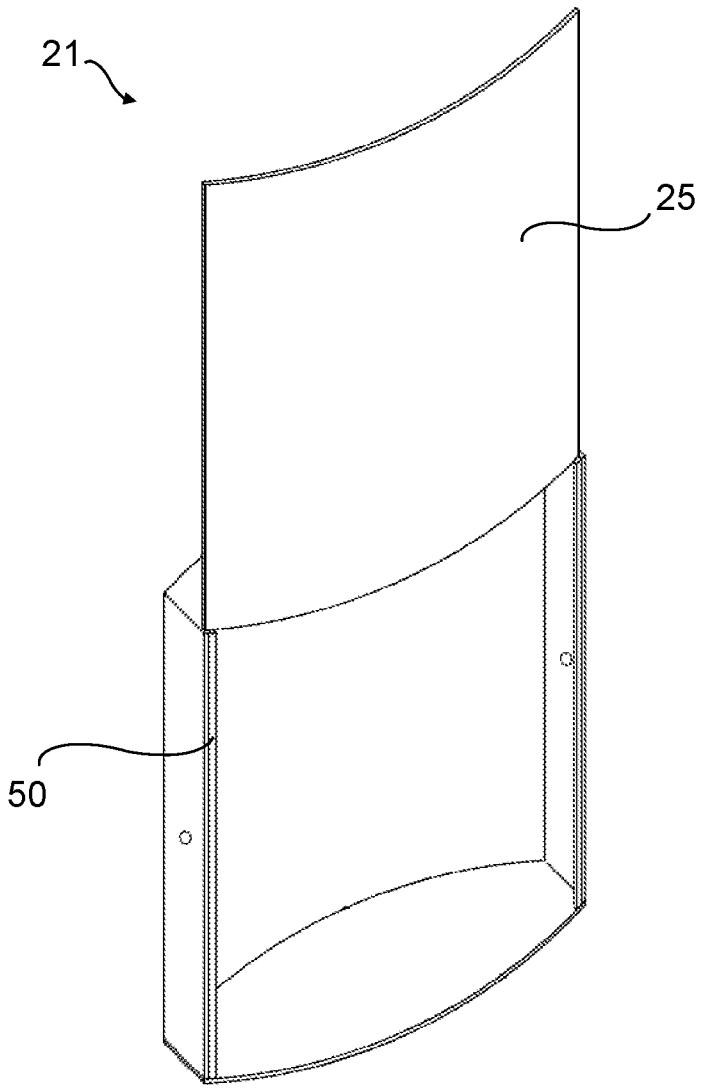
FIG. 6 shows an isometric of the casing in an opened state, according to one of the preferred modalities.

Said connection points (50) include a ribbed profile for guiding and sliding of frontal panel (25) or posterior panel (26) of the casing (21), those panels being flat sheets, although alternatively, the mentioned frontal (25) and posterior (26) panels may be curved, as illustrated in FIG. 5 and FIG. 6.

Figure 7:
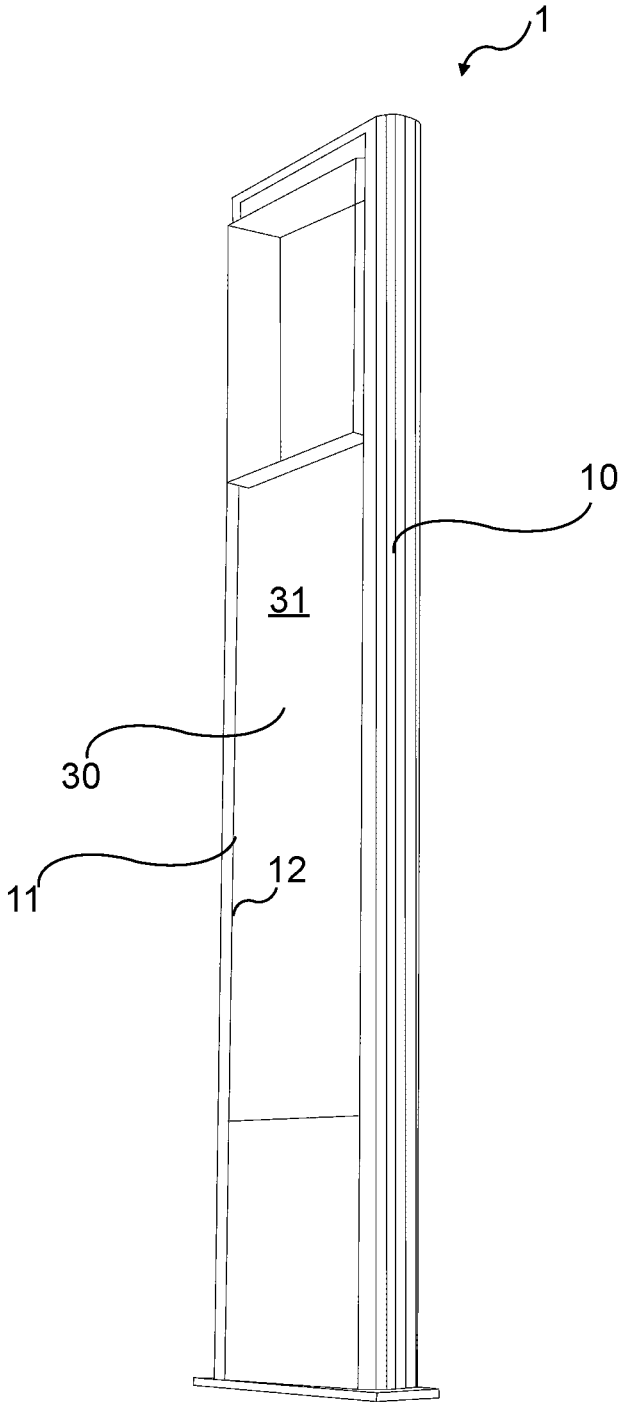
FIG. 7 shows an isometric view of the pedestal according to one of the preferred modalities.

As better illustrated in FIG. 7, the means of graphic support (30) to install and remove graphic information sheets include parallel panels (31) which are secured in a removable manner at the interior (11) of the perimeter frame (10) throughout a smaller sized perimeter frame (12). Said parallel panels (31) are translucent in appearance and shaped as flat sheets.

The invention claimed is:

1. An anti-theft pedestal (1) alarm system configured to be placed at the entrance of a commercial establishments to exhibit physical products comprising:

a perimeter frame shaped structure (10), wherein the perimeter frame shaped structure (10) further comprises:

a means to support and exhibit (20) at least one volumetric products; and a means of graphic support (30) to exhibit graphic content and install and remove graphic information sheets;

wherein the means to support and exhibit (20) comprises:

a box-shaped casing (21) comprised of an upper panel (23) and an inferior panel (24), opposing lateral panels (22) which have connection points (50) to a frontal panel (25) and a posterior panel (26) and the connection points (50) possess a ribbed profile for sliding the frontal panel (25) or posterior panel (26) of the casing (21); and a closing device to ensure a closing position of the panels to the casing.

2. The anti-theft pedestal (1) alarm system, according to claim 1, wherein the perimeter frame shaped structure (10) contains a set of circuits related to the anti-theft alarm system.

3. The anti-theft pedestal (1) alarm system, according to claim 2, wherein the perimeter frame shaped structure (10) includes a center space (40) which is configured to hold and exhibit (20) the physical products and graphic support media (30).

4. The anti-theft pedestal (1) alarm system, according to claim 1, wherein the frontal panel (25) and/or posterior panel (26) are curved sheets.

5. The anti-theft pedestal (1) alarm system, according to claim 1, wherein the frontal panel (25) and/or posterior panel (26) are flat sheets.

6. The anti-theft pedestal (1) alarm system, according to claim 1, wherein the upper panel (23) of the casing (21) includes a notch on at least one of its main sides.

7. The anti-theft pedestal alarm system (1), according to claim 1, wherein the casing (21) is translucent in appearance.

8. The anti-theft pedestal (1) alarm system, according to claim 1, wherein the graphic support (30) is configured to install and remove graphic information sheets, and includes parallel opposing panels (31) fitted in a removable manner at the inner side (11) of a perimeter frame.

9. The anti-theft Anti-theft pedestal (1) alarm system, according to claim 8, wherein the parallel opposing panels (31) fitted in a removable manner at the inner side (11) of the perimeter frame (10) throughout a smaller sized perimeter frame (12).

10. The anti-theft pedestal (1) alarm system, according to claim 8, wherein the parallel panels (31) are translucent in appearance.

11. The anti-theft pedestal (1) alarm system, according to claim 8, wherein the parallel panels (31) are flat sheets.

12. The anti-theft pedestal (1) alarm system, according to claim 8, wherein the parallel panels (31) are curved sheets.

* * * * *